United States Patent [19]

Vignon

[11] Patent Number: 4,658,574

[45] **Date of Patent: * Apr. 21, 1987**

[54] APPARATUS FOR THE PRODUCTION OF WRAPPED YARN

[75] Inventor: Louis Vignon, Geneva, Switzerland

[73] Assignee: Heberlein Hispano S.A., Vernier/Geneva, Switzerland

[ * ] Notice: The portion of the term of this patent subsequent to Apr. 22, 2003 has been disclaimed.

[21] Appl. No.: 817,576

[22] Filed: Jan. 10, 1986

[30] Foreign Application Priority Data

Jan. 17, 1985 [CH] Switzerland ..... 213/85

[51] Int. Cl.[4] ..... D02G 3/36; D01H 5/28

[52] U.S. Cl. ..... 57/5; 57/304; 57/328; 57/334; 57/401

[58] Field of Search ..... 57/5, 328, 6, 12, 334, 57/401, 304, 305, 350

[56] References Cited

U.S. PATENT DOCUMENTS

| | | | |
|---|---|---|---|
| 3,768,243 | 10/1973 | Brown et al. | 57/5 X |
| 4,222,222 | 9/1980 | Didek et al. | 57/5 X |
| 4,249,368 | 2/1981 | Fehrer | 57/5 |
| 4,274,250 | 6/1981 | Lippmann | 57/5 |
| 4,351,146 | 9/1982 | Faure et al. | 57/328 X |
| 4,472,931 | 9/1984 | Stahlecker | 57/304 X |
| 4,488,397 | 12/1984 | Venot | 57/328 |
| 4,489,540 | 12/1984 | Faure et al. | 57/328 X |
| 4,583,355 | 4/1986 | Vignon | 57/5 |

FOREIGN PATENT DOCUMENTS 84-04550 11/1984 Int'l Pat. Institute .

*Primary Examiner*—John Petrakes

*Attorney, Agent, or Firm*—Young & Thompson

[57] ABSTRACT

The apparatus comprises a stretching unit (S) delivering two stretched fiber rovings (4, 5). One fiber roving (4) serves as the core for the wrapped yarn to be produced and runs to a twist-imparting device (6, 7). The fibers of the other fiber roving (5) are transferred to a moving fiber feeding and holding surface (9) constituted by a perforated peripheral surface of a hollow disk (10). This surface (9) comes into contact with the core (4) at a point (C) in front of the twist-imparting device (6, 7). At this contact point (C), the fibers fed on the surface (9) are seized by the rotating core (4) and wound up. At the contact point (C), a fiber catching device (12) is likewise arranged, having an air-permeable surface (11) behind which a vacuum is maintained. Fibers fed along the fiber feeding and holding surface (9) which separate from this surface (9) before they have been wound up completely on the core (4) are sucked against the air-permeable surface (11) of the fiber catching device (12) and retained until they have been completely wound up. In this way, all fibers are wrapped onto the core (4) in stretched condition even at high operating velocities.

7 Claims, 2 Drawing Figures

APPARATUS FOR THE PRODUCTION OF WRAPPED YARN

Figure 1:
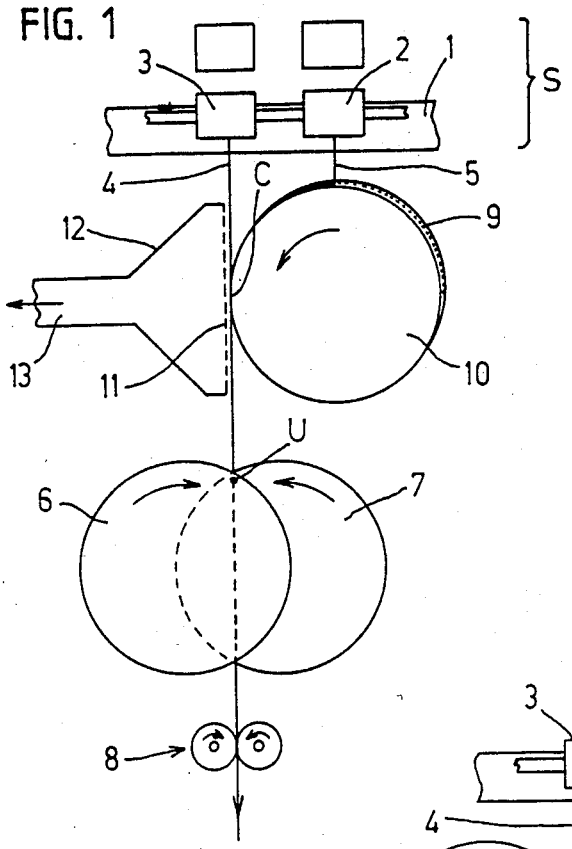

The invention relates to an apparatus for the production of wrapped yarn.

Such an apparatus has been described in WO-A-84/04550. In the latter, oriented, parallelized fibers held on the fiber feeding and retaining surface are conveyed to the core. At the point where the fiber feeding and retaining surface comes into contact with the core, the forward ends of the delivered fibers are seized by the rotating core, and the fibers are wound onto the core. The rearward ends of the fibers are to be retained on the fiber feeding and holding surface in this step so that the fibers remain stretched and parallelized during the winding-up operation. Since it can happen that the rearward ends of the fibers are prematurely detached from the fiber feeding and holding surface, a fiber catching device is arranged in the zone of the fiber transfer point, which device is to restrain such rearward fiber ends.

The fiber catching device, in the conventional arrangement, takes the shape of a small brush. However, it has been found that the effectiveness of such a mechanical fiber catching brush ceases to be adequate if an attempt is made to raise the operating speed of the apparatus, for example to more than 300 m/min running speed of the core, during which operation the core must revolve at several hundred thousand rpm. At such high velocities, a normal brush can no longer reliably prevent the fibers from projecting away from the core, or even detaching themselves from the core, under the effect of centrifugal force. If an attempt is made to reinforce the action of the brush, for example by using a denser brush, then irregularities are produced in the thus-manufactured wrapped yarn, and great tension fluctuations occur caused apparently by catching of the fibers at the bristles of the brush. Furthermore, the brush will become dirty during the course of time so that its effect is not constant.

Therefore, the object of the invention resides in fashioning, in an apparatus of the above-indicated type, the fiber catching device in such a way that it can reliably retain fibers leaving the fiber feeding and holding surface, with a uniform, controllable action even at high operating speeds, until the fibers have been completely wound onto the core.

This object has been attained according to the invention by providing that the fiber catching device has an air-permeable surface, and means for maintaining a vacuum behind this surface.

By maintaining a vacuum behind the air-permeable surface, for example a perforated wall or a grid, the fibers exiting from the fiber feeding and holding surface, which are not as yet sufficiently wound onto the core, are sucked against the air-permeable surface and then retained on the latter until they have been entirely wound up on the core. Due to the retention of the fibers, this winding-up operation takes place under a certain tension, so that the fibers remain stretched, resulting in improved quality of the thus-produced wrapped yarn. An additional advantage resides in that the suction force can be changed readily by regulation of the vacuum, and can be adapted to the relationships prevailing in a particular case, for example to the operating speed of the apparatus. In contrast to the conventional brush, the effect of the air-permeable surface can be regulated with a vacuum in a constant and accurate fashion in the apparatus of this invention.

Figure 2:
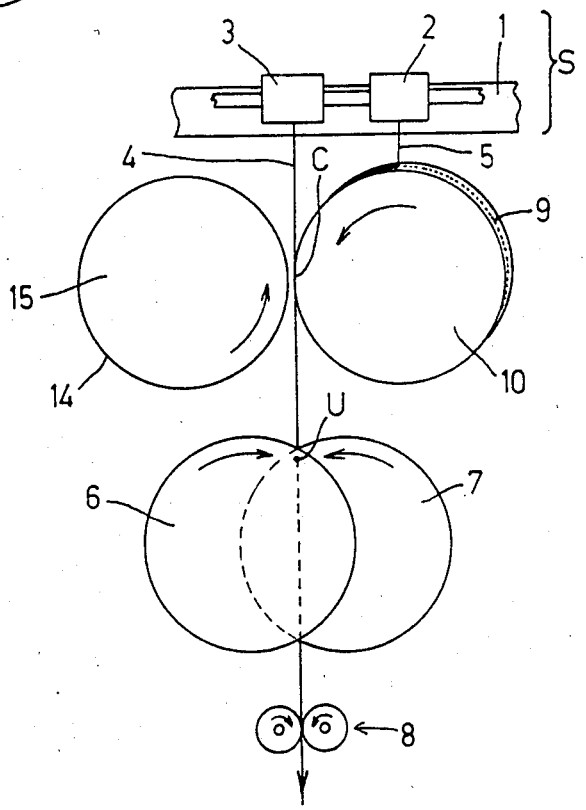

Embodiments of the apparatus according to the invention will be described in greater detail below with reference to the drawing wherein:

FIG. 1 and FIG. 2 show respectively schematically in a top view an apparatus for producing wrapped yarn.

The illustrated arrangements each comprise a stretching unit S, shown only in part, with delivery rolls 1, 2, 3, discharging two stretched fiber rovings 4 and 5. One fiber roving 4, serving as the core for the wrapped yarn to be produced, runs to a twist-imparting means. In the illustrated embodiments, the twist-imparting means consists of two mutually opposed, approximately parallel friction disks 6 and 7 revolving in opposite directions and coming into contact with the delivered yarn at a peripheral point U, setting the yarn into rotation. Downstream of the twist-imparting means, the yarn then runs to a take-off device 8 and subsequently is wound up on bobbins as is conventional (not illustrated).

In place of the fiber roving 4, it would also be possible to utilize, as the core, an endless filament or a combination of fiber roving and endless filament.

The other stretched fiber roving 5 is pulled onto a fiber feeding and holding surface 9 which moves and comes into contact,at a point C in front of the twist-imparting means 6, 7,with the core (fiber roving 4). The fiber feeding and holding surface 9 is constituted, in the illustrated examples, by an annular, air-permeable (for example perforated) peripheral surface on a revolving hollow disk 10; in the latter, a vacuum is maintained by means of a suction line, not illustrated. The travel velocity of the peripheral surface 9 is somewhat higher than the feeding speed of the fiber roving 5 so that the oriented, parallelized fibers of this fiber roving are transferred to the peripheral surface 9 in stretched condition. The fibers are then retained on the peripheral surface 9 by the vacuum and moved with the peripheral surface to the contact point C with the core (fiber roving 4) where the forward ends of the fibers are seized by the rotating core, and the fibers are wrapped onto the core. During the wrapping step, the rearward ends of the fibers are held back on the peripheral surface 9 (by the vacuum ambient in the hollow disk 10), so that the fibers remain tensioned and do not lose their orientation and parallelization. The core with the covering yarn wrapped thereon then travels as wrapped yarn through the twist-imparting means 6, 7 and to the take-off device 8.

With an increase in the operating speed of the apparatus, for example to above 300 m/min traveling velocity of the core and/or of the thus-produced wrapped yarn, the fibers delivered on the peripheral surface 9, especially if they are relatively short, tend increasingly to detach themselves from the peripheral surface 9 under the effect of centrifugal force, before they have been entirely wrapped onto the core. At high operating speeds, the core revolves, at contact point C, at several hundred thousand rpm. Fibers that escape prematurely from the peripheral surface 9 can no longer be properly wrapped around the core without incurring difficulties. Fibers which have not been adequately seized by the core could even be flung away from the latter.

In order to counteract such difficulties and provide that the fibers fed to the core will be wrapped onto the core in a stretched condition and completely, even at high operating velocities, a fiber catching device is arranged at the contact point C, in opposition to the fiber feeding and holding surface 9, in order to retain fiber ends that have become detached from the fiber feeding and holding surface 9.

In the embodiment according to FIG. 1, the fiber catching device exhibits an air-permeable surface in the form of a suction screen 11 extending in parallel to the axis of the core 4. The suction screen 11 is located in the orifice of a funnel 12 to which a vacuum source (not shown) is connected by way of a suction line 13, maintaining a vacuum behind the screen 11. Thereby, fibers, leaving the peripheral surface 9 but not having been adequately seized by the revolving core as yet, are sucked against the screen 11 and held thereon until they have been completely wrapped on the core. During this step, a certain tension is maintained in these fibers during wrapping, whereby the quality of the thus-manufactured wrapped yarn is improved.

In the embodiment according to FIG. 2, the fiber catching device has an air-permeable surface in the shape of a perforated peripheral wall 14 of a rotating hollow disk 15, the interior of the latter again being in communication with a vacuum source (not shown) in the region of contact point C, at least. Fibers fed by the fiber feeding and holding surface 9 to the core 4 that are detached during wrapping around the core are sucked against the peripheral wall 14 of the disk 15 and retained thereon. The peripheral wall 14 travels, at contact point C, in the opposite direction to the movement of the peripheral surface 9 and the core 4, whereby the fibers, during wrapping around the core, are held in an even more advantageously tensioned and stretched condition than in the embodiment according to FIG. 1. In a modified embodiment, though, the peripheral wall 14 could also travel in the same direction as the movement of the peripheral surface 9 and the core 4, at contact point C, in order to prevent delivered fibers that have been only barely seized by the core 4 from being pulled away again from the core. The hollow disk 15 in this version would thus revolve in opposition to the illustrated arrow.

What is claimed is:

1. In an apparatus for the production of wrapped yarn, comprising a delivery device (1, 3) for feeding a core (4), twist-imparting means (6, 7) for receiving and twisting said core, a movable fiber feeding and holding surface (9) between said delivery device and said twist-imparting means for feeding fibers to the core (4), which feeding and holding surface comes in contact with the core (4) at a point (C) between the delivery device (1, 3) and the twist-imparting means (6, 7), means (1, 2) for feeding parallel fibers to the movable fiber feeding and holding surface (9) at a location lying, in the direction of movement of the surface, upstream of the contact point (C) with the core (4), and a take-off device (8) for drawing the wrapped yarn out of the twist-imparting means (6, 7); the improvement comprising, at the point (C) where the fiber feeding and holding surface (9) contacts the core (4), a fiber catching device (11, 12, 13; 14, 15) for retaining fiber ends that have become detached from the fiber feeding and holding surface (9), said fiber catching device being disposed on the side of the core opposite said surface (9), the fiber catching device having an air-permeable surface (11; 14), and means (12, 13; 15) for maintaining a vacuum behind this latter surface thereby to retain fibers against this latter surface until they have been completely wound up on the core.

2. Apparatus according to claim 1, characterized in that the air-permeable surface (11) is fixedly arranged.

3. Apparatus according to claim 1, characterized in that the air-permeable surface (14) is movably arranged.

4. Apparatus according to claim 3, characterized in that the air-permeable surface (14) is located on a rotatable hollow disk (15).

5. Apparatus according to claim 3, characterized in that drive means for the air-permeable surface (14) are provided for moving this surface (14), at the point (C) where the fiber feeding and holding surface (9) comes in contact with the core (4), in opposition to the travel direction of the core (4).

6. Apparatus according to claim 1, characterized in that the fiber feeding and holding surface (9) is likewise air-permeable, and means are provided for maintaining a vacuum behind this surface.

7. Apparatus according to claim 6, characterized in that the fiber feeding and holding surface (9) is an annular surface on a rotatable hollow disk (10).

* * * * *